US010602271B2

(12) United States Patent
Kleeven et al.

(10) Patent No.: US 10,602,271 B2
(45) Date of Patent: Mar. 24, 2020

(54) SOUND SYSTEM, END OF LINE DEVICE AND END OF BRANCH DEVICE

(71) Applicant: Robert Bosch GmbH, Stuttgart (DE)

(72) Inventors: Guus Kleeven, Sevenum (NL); Kees Nuijten, Bergen op Zoom (NL)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/267,913

(22) Filed: Feb. 5, 2019

(65) Prior Publication Data

US 2019/0246207 A1 Aug. 8, 2019

(30) Foreign Application Priority Data

Feb. 6, 2018 (EP) ..... 18155208

(51) Int. Cl.
*H04R 3/12* (2006.01)
*H04R 27/00* (2006.01)
*H04R 29/00* (2006.01)

(52) U.S. Cl.
CPC ..... *H04R 3/12* (2013.01); *H04R 27/00* (2013.01); *H04R 29/002* (2013.01); *H04R 29/007* (2013.01)

(58) Field of Classification Search
CPC ..... H04R 3/12; H04R 27/00; H04R 29/002
See application file for complete search history.

(56) References Cited

U.S. PATENT DOCUMENTS

2008/0317252 A1 12/2008 Tjalsma et al.
2014/0161265 A1 6/2014 Chaikin et al.

FOREIGN PATENT DOCUMENTS

DE 102010028022 10/2011
DE 202015001656 3/2015

*Primary Examiner* — Mark Fischer
(74) *Attorney, Agent, or Firm* — Michael Best & Friedrich LLP

(57) ABSTRACT

A sound system 1 comprising at least one monitoring device 8, a source device 4 and a transmission medium 6, wherein the monitoring device 8 is connected with the source device 4 via the transmission medium 6, wherein the monitoring device 8 is adapted to receive a monitoring signal 9 sent by the source device 4, wherein the monitoring device 8 is a passive device and adapted to send at least one harmonic of the monitoring signal back to the source device 4.

17 Claims, 3 Drawing Sheets

SOUND SYSTEM, END OF LINE DEVICE AND END OF BRANCH DEVICE

BACKGROUND OF THE INVENTION

This invention relates to a sound system comprising at least one monitoring device, a source device and a transmission medium.

Sound systems are sound systems informing and entertaining a public in buildings or public places, for example airports or railway stations. These systems can also be used for warning the public in any emergency events. Such sound systems comprise several loudspeakers and amplifiers. The loudspeakers are often arranged in lines. For a good performance it is necessary to monitor the connection and correctness of the loudspeakers and the lines.

To supervise sound systems, there are several techniques known in the state of the art. For example, it is possible to supervise the loudspeaker line using a DC-signal, since the DC-signal is not converted to acoustical sound waves by a loudspeaker. Loudspeakers using this technique need an extra component in their design, such that the DC-signal is not shorted by the loudspeaker coil. This makes an existing sound system difficult to upgrade. There is also the possibility to supervise the sound system using AC-signals. Since an AC-signal is converted to acoustical sound waves by the loudspeakers, such signals are used in a frequency range, where they are not audible for the human ear.

Most supervising systems are used as end of the line devices, which are connected at the end of a loudspeaker line. These devices either detect the supervision signal and send back a different signal or it forms a load, which can be detected. If the end of the line devices are forming a load, they have to be calibrated to the cable length and therefore tested in the field.

The document DE 10 2010 028 022 A1, which seems to be the closest state of the art, describes a technique for supervising a loudspeaker line. The loudspeaker line connects a first point (main module) with a second point (supervising module). Main module and supervising module are able to communicate with each other. The loudspeaker line has an impedance, which can be variated by a communication partner to transmit a digital communication signal.

SUMMARY OF THE INVENTION

The invention provides a sound system, an end of line device and an end of branch device.

According to the invention, a sound system is suggested. The sound system is especially adapted as a public address system. The sound system is for example for an indoor area or an outdoor area. The sound system is for example for a hospital or an airport. The sound system is adapted for presenting music, announcement or warnings to a crowd. The sound system is adapted to transform an audio signal into acoustic waves, whereby the sound system is controlled and/or driven by the audio signal.

The sound system comprises at least one monitoring device, at least one source device and a transmission medium. Specifically, the transmission medium is connecting the monitoring device with the source device. The transmission medium is for example a wire or a cable, and particularly the transmission medium is a two wire line. The source device is especially adapted to provide the audio signal. Especially, the sound system comprises several loudspeakers, whereby the loudspeakers are for example arranged in a loudspeaker line. The loudspeakers are particularly connected with the source device, especially connected in a line via the transmission medium. The source device is for example a computer unit and/or is comprising a computer. Preferably, the source device has a low impedance, as advantage to detect a current provided to the source device, e.g. provided by the monitoring device.

The monitoring device is adapted to receive a monitoring signal sent by the source device. The source device is especially adapted to provide the monitoring signal. The monitoring signal is especially an AC-signal. In particular, the monitoring signal is also called pilot tone. The monitoring signal has a frequency, whereby the frequency is for example larger than 20 kilohertz. Especially the monitoring signal is 25.5 kHz. The monitoring signal can be a constant signal or a pulsed signal.

The monitoring device is a passive device. Especially the monitoring device does not comprise and/or does not use active units, for example microchips, to process the monitoring signal. Particularly, the monitoring device need as electric energy supply only the energy carried by the monitoring signal. Especially the monitoring device is a passive device in the way that power for operating the monitoring device is taken and/or carried by the monitoring signal. The monitoring device is adapted to send at least one harmonic of the monitoring signal back to the source device. Furthermore, the monitoring device can be adapted to send several harmonic of the monitoring signal back to the source The harmonic provided by the monitoring device is an integer multiple of the frequency of the monitoring signal.

It is a consideration of the invention, that supervising systems for sound systems in the state of the art are technically complex and large, when they return a generated signal. On the other hand, systems applying a load for supervising the sound system has the drawback, that the loudspeaker line itself will affect the performance of the device. The invention provides a simple device, which for example can perform across different cable lengths and with any variety of load connected to the system. There is a sound system disclosed that removes as much intelligence from the device as possible and moves these functions to the source device.

It is an advantage of this invention that the sound system and especially the monitoring device has a low power consumption. Furthermore, the sound system and the monitoring device is reliable across long distances.

Preferably, the harmonic sent by the monitoring device is the second harmonic of the monitoring signal. Especially, the monitoring device is adapted as a second harmonic generation device.

Particularly, the monitoring device is adapted as an end of line device. For example, the control device and/or the end of line device is connected at the end of the transmission medium and/or the loudspeaker line. The end of line device is in particular adapted to detect, if the transmission medium and/or the loudspeaker line is working correctly and/or is intact.

In a preferred embodiment of the invention, the monitoring device comprises a resonant circuit. The resonant circuit has a resonant frequency, whereby the resonant frequency is preferably the frequency of the monitoring signal. Particularly, the resonant circuit has a large Q-factor, whereby the Q-factor is describing the dampening of the resonator. Especially, the resonant circuit is made and/or formed by a capacitor and an inductor. For example, the capacitor and the inductor are connected in series.

Particularly, the monitoring device comprises at least one diode. Especially, the monitoring device comprises exactly three diodes. The diode and/or the diodes are connected parallel to the inductor. Particularly, the diodes are connected in series with the capacitor. When an AC-signal, especially the monitoring signal, is applied to the resonator, whereby the monitoring signal has the resonant frequency, the voltage across the inductor is increasing, however the diodes will limit this effect, because they will short out one half of the AC-signal voltage swing. This can be referred to as a clipping effect and will generate a second harmonic, which will flow back to the source device. The harmonic sent by the monitoring device is also called answer signal. Furthermore, due to the resonating circuit it is possible to lower the voltage of the monitoring signal. It is a suggestion of the invention to have a device that will not create harmonics from an audio signal but is working reliable with the monitoring signal.

The resonance frequency is preferably far away from the audio frequency. For example, the resonant frequency has a frequency at least twice of a maximum audio frequency. For example, the resonant frequency is larger than 20 kilohertz and smaller than 50 kilohertz.

Preferably, the source device comprises a measurement unit to detect the harmonic sent by the monitoring device. For example, the measurement device is a device for measuring a current. Preferably, in order to measure the answer signal a current sensor tuned for the frequency of that signal is used. Especially, the measurement unit comprises a multimeter. In a particular embodiment, the measurement unit is adapted to detect the frequency of the harmonic. Furthermore, the source device can comprise an evaluation unit, whereby the evaluation unit is adapted to detect signals based on the detected harmonic sent by the monitoring device, if the loudspeaker line and/or the sound system is working correctly or any problems are present. Preferably, the measurement unit is adapted to measure an average of the second harmonic and/or an integral of the second harmonic, in order to reduce the risk of generated harmonics of the audio signal triggering the measuring or evaluation unit. It is a suggestion of the invention to have the intelligence in the source device instead of the monitoring device.

Particularly, the sound system comprises at least one switch device. The switch device is also called switch. The switch device is especially adapted for connecting and/or disconnecting the monitoring device with the source device. The switch is for example adapted for selective polling to each monitoring device. It is preferred, that the sound system comprising a number of monitoring devices is comprising the same number of switches. The switch can be an active switch, alternatively the switch can be a passive switch.

Preferably, the switch device together with the monitoring device is forming an end of branch device. The end of branch device, which is comprising the switch device and the monitoring device, can form an assembly. As an end of branch device, the sound system is having several loudspeaker lines, which are extending and/or branching out from the source device. The end of branch device is for example located at the end of a branch and/or having the maximum distance in the loudspeaker line. The branches can be numbered by a user, whereby for example each end of branch device and/or switch is assigned with the same number. By polling the switch and/or end of branch device with pulses of the monitoring signal, the monitoring device can be connected with the source device when this number of pulses was detected and/or sent.

Optionally, the end of branch device and/or the switch device comprises a supply unit, whereby the supply unit is adapted to convert the energy carried by the monitoring signal into a usable voltage for the end of branch device and/or switch. For example, the supply unit is a transformer unit.

In a possible embodiment of the invention, the switch comprises a one shot unit. The one shot unit is for example a one shot circuit and/or a monostable multivibrator. The one shot unit is adapted to produce a single output pulse, when it is triggered externally. The external triggering can be done with the monitoring signal. For example, the one shot unit is adapted to generate a single pulse when it is triggered with the monitoring signal.

The switch also comprises a counter unit. The counter unit is counting the number of pulses given from and/or received by the one shot unit. The one shot unit is electrically connected with the counter unit. For example, the counter unit is adapted to count to a maximum number and then starting again with zero or one and count again to the maximum number. The maximum number is for example larger than five and smaller than 20.

The switch also comprises a jumper unit, whereby the jumper unit has a jump number, whereby the jump number is for example user adjustable. The jumper unit may also be adapted as and/or comprise a rotary switch or any other kind of switch mechanism. The jumper is adapted to connect the monitoring device with the source device, when the counter unit is counting the jumper number. These embodiment can be used to connect different monitoring devices to the source device just by triggering the switches with different pulse numbers of the monitoring signal.

Preferably, the supply unit is adapted to charge the monitoring device, the switch and/or the end of branch device for the first triggering with a monitoring signal. This means for example, that giving out just one pulse of the monitoring signal, the monitoring device, the end of branch device and/or the switch are charged with electricity and/or only the second and following triggering and/or pulses are used for connecting and disconnecting the monitoring device.

Preferably, the switch device comprises a band pass for the monitoring signal. Particularly, the band pass is between the source device and the one shot unit. The band pass has a large Q-factor and dampens the audio signal.

The invention also concerns an end of line device. The end of line device is preferably for a sound system and for example for the sound system as described before. The end of line device comprises a monitoring device, wherein the monitoring device is connectable with the source device, for example via the transmission medium. The monitoring device is adapted to receive a monitoring signal and send back a harmonic of the monitoring signal. For example, the monitoring signal is sent by the source device.

Furthermore, the invention concerns an end of branch device for a sound system. Especially, the sound system is like described before. The end of branch device comprises the end of line device, and also comprises the switch device, wherein the switch device is connected in line with the end of line device.

BRIEF DESCRIPTION OF THE DRAWINGS

Further advantages are derived in the figures and the description of the figures.

DETAILED DESCRIPTION

Figure 1:
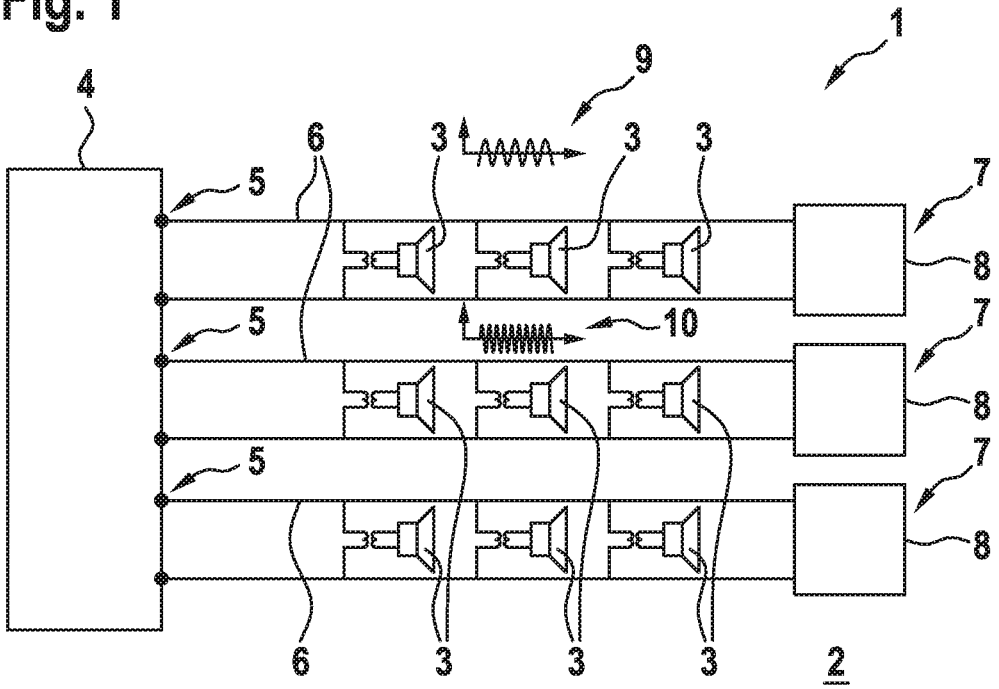
FIG. 1 shows a sound system as a first execution example.

FIG. 1 shows a sound system 1 for announcing messages, a warning or playing music in a sonication area 2. The sonication area 2 is for example a hospital, a railway station or an airport. The sound system 1 comprises a number of loudspeakers 3, whereby the loudspeakers 3 are arranged in the sonication area 2.

The sound system 1 comprises a source device 4. The source device 4 is for example a computer unit and is preferably a central source device. The source device 4 is adapted to provide an audio signal to the loudspeakers 3. The loudspeakers 3 are adapted to acoustic irradiate the audio signal into the sonication area 2. Therefore, the source device 4 comprises several interfaces 5, whereby the interfaces 5 are for example interfaces 5 for a cable connection. The source device 4 is connected via a transmission medium 6 with the loudspeakers 3. The transmission medium 6 is for example a cable and especially a two-wire-cable. The transmission medium 6 is connected with and/or via the interface 5. The transmission medium 6 is for transferring the audio signal to the loudspeakers 3. The loudspeakers 3 are arranged in loudspeaker lines 7, whereby each loudspeaker line 7 comprises a subset of the loudspeaker 3.

Each loudspeaker line 7 comprises a monitoring device 8. The monitoring device 8 is adapted as an end of line device. The end of line device and/or the monitoring device 8 is connected via the transmission medium 6 to the source device 4, especially to the interfaces 5. The monitoring device 8 is also receiving the audio signal provided by the source device 4. End of line device means especially, that the loudspeakers 3 in the loudspeaker line 7 are all arranged between the source device 4 and the end of line device, here the monitoring device 8.

The source device 4 is adapted to provide a monitoring signal 9. The monitoring signal 9 can be a pulse. Especially, the monitoring signal 9 is an AC-signal. The monitoring signal 9 is transferred via the transmission medium 6 to the monitoring device 8. The monitoring device 8 is adapted to create an answer signal 10, whereby the answer signal 10 is a harmonic of the monitoring signal 9. Especially, the answer signal 10 and/or the harmonic of the monitoring signal 9 is the second harmonic of the monitoring signal 9. For example, the answer signal 10 has a fractional power of the monitoring signal 9. The answer signal 10 and therefore the harmonic of the monitoring signal 9 is provided by the monitoring device 8 to the source device 4. The source device 4 comprises a measurement unit to measure the answer signal 10. If the loudspeaker line 7 is working correctly, the monitoring signal 9 is transferred in the answer signal 10 and therefore, if the answer signal 10 is detected by the measurement unit, the measurement unit is able to rate the loudspeaker line 7 as intact.

Based on the different interfaces 5 for the different loudspeaker lines 7 it is possible to transfer different audio signals into the different loudspeaker lines 7.

Figure 2:
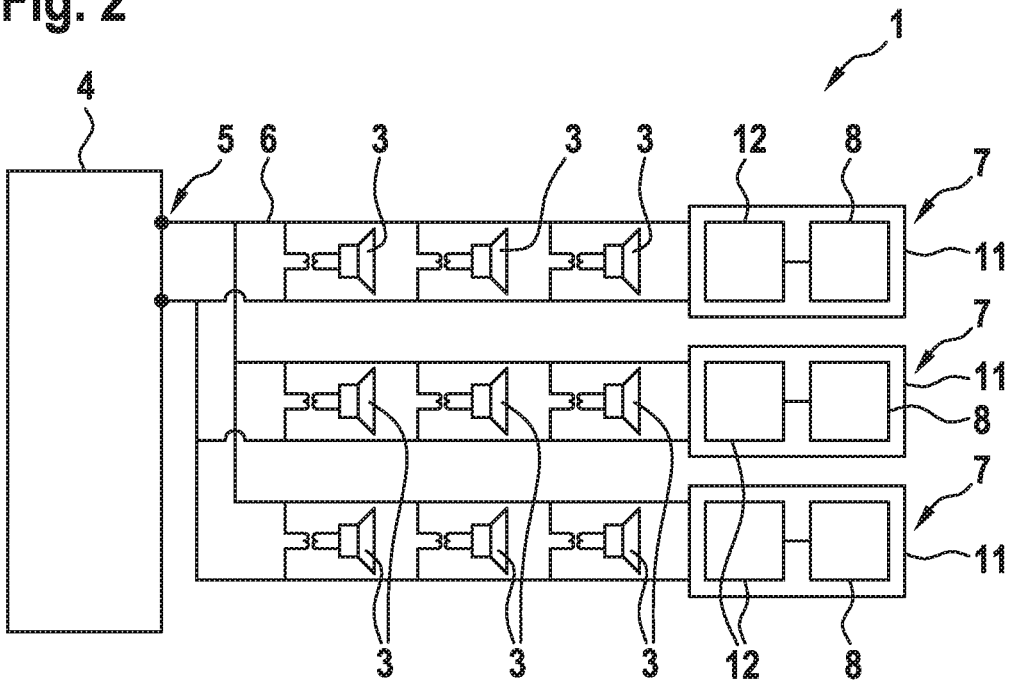
FIG. 2 shows a sound system as a first execution example.

FIG. 2 shows a second execution example of sound system 1. The sound system 1 comprises three loudspeaker lines 7, whereby the loudspeaker lines 7 are adapted as branches from the source device 4. The source device 4 comprises only one interface 5, whereby the interface 5 is the origin of the three loudspeaker lines 7. The interface 5 is connected with the transmission medium 6 and the transmission medium 6 is connecting the loudspeakers 3 of the loudspeaker lines 7 to the source device 4. In contrast to the example of FIG. 1, in this example it is only possible to use the same audio signal for all the loudspeaker lines 7. The loudspeaker lines 7 are forming a parallel connection.

The loudspeaker lines 7 are comprising an end of branch device 11. The end of branch device 11 is at the end points of the loudspeaker lines 7, whereby the endpoints mean that all the loudspeakers 3 in a loudspeaker line 7 are arranged between the end of branch device 11 and the source device 4.

The end of branch device is adapted to detect, if the branch and/or the loudspeaker line 7 is working correctly. The end of branch device 11 is adapted to send a second harmonic back to the source 5, if the end of branch device 11 is triggered with the monitoring signal correctly.

The end of branch device 11 comprises the monitoring device 8, which is forming a passive electronic component and a switch 12, whereby the switch 12 is preferably an active electronic component. The switch 12 is connecting the source device 4 in line with the monitoring device 8. The switch 12 connects the monitoring device 8 to the interface 5, if it receives the monitoring signal and/or receives the right number of the monitoring signal 9. When the monitoring device 8 is connected with the interface 5, the answering signal 10 is passed from the monitoring device 8 through the switch 12 to the source device 4.

The switches 12 in the different loudspeaker lines 7 are assigned with different check numbers, whereby the check numbers are the numbers of monitoring signals that have to be detected in order to connect the monitoring device 8 with the source device 4. The check number are for example the jump numbers.

For example, one switch is having the check number two, the next switch 12 has the check number three and the third switch 12 has the check number four. The sound system 1 is then operated in a way, that when the monitoring signal is given once, the check number is one and all the end of branch devices and/or switches 12 are charged with electricity. By sending out the next monitoring signal, the counted number of monitoring signals is two and therefore the check number two corresponds to the detected monitoring signals and the first switch is connecting its monitoring device 8 with the source device 4. Then another monitoring signal is sent out by the source 4 and the counted number of monitoring signals is three which corresponds to the check number of the second switch, and therefore the second switch 12 is connecting its monitoring device 8 with the source device 4. On the other hand, when the second switch is connecting its monitoring device 8 to the source 4, the monitoring device 8 is disconnected by the switch 12 of the first end of branch device 11. When the fourth monitoring signal is sent, the check number of the third switch corresponds to the detected monitoring signals and therefore the third switch is connecting its monitoring device 8 to the source device 4. This method can be used to check, if all the loudspeaker lines 7 and/or branches of the sound system 1 are working correctly.

Figure 3:
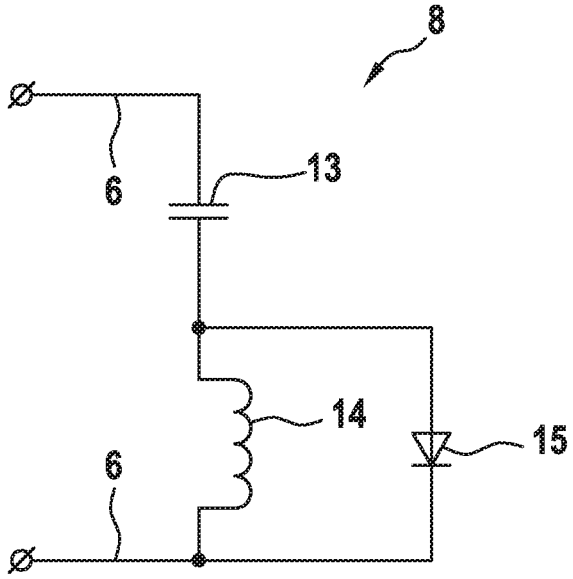
FIG. 3 shows a circuit diagram of a monitoring device.

FIG. 3 shows an example of a circuit diagram of the monitoring device 8. The monitoring device 8 comprises a capacitor 13 and an inductor 14. The inductor 14 and the capacitor 13 are connected in line and forming a resonator. The resonator has a resonating frequency, whereby the resonance frequency is in the range of the monitoring signal 9. Especially, the monitoring signal 9 has a frequency that is larger than 20 kilohertz and is far away from the frequency of the audio signal. The capacitor 13 and the inductor 14 are connected with the transmission medium 6. The transmission medium 6 is providing the monitoring signal 9 to the resonator and/or to the monitoring device 8.

The monitoring device 8 comprises a diode 15. The diode 15 is connected parallel to the inductor 14. The monitoring signal is applied to the capacitor 13 and inductor 14, whereby the resonator is starting to swing. However this swing of the resonator will be limited by the diode 15, since the diode 15 will short out one half of the monitoring signal 9. The diode 15 is therefore acting with a clipping effect and generate the second harmonic of the monitoring signal 9. The second harmonic of the monitoring device 9 is forming the answering signal 10 and is provided to the source device 4 via the transmission medium 6.

Figure 4:
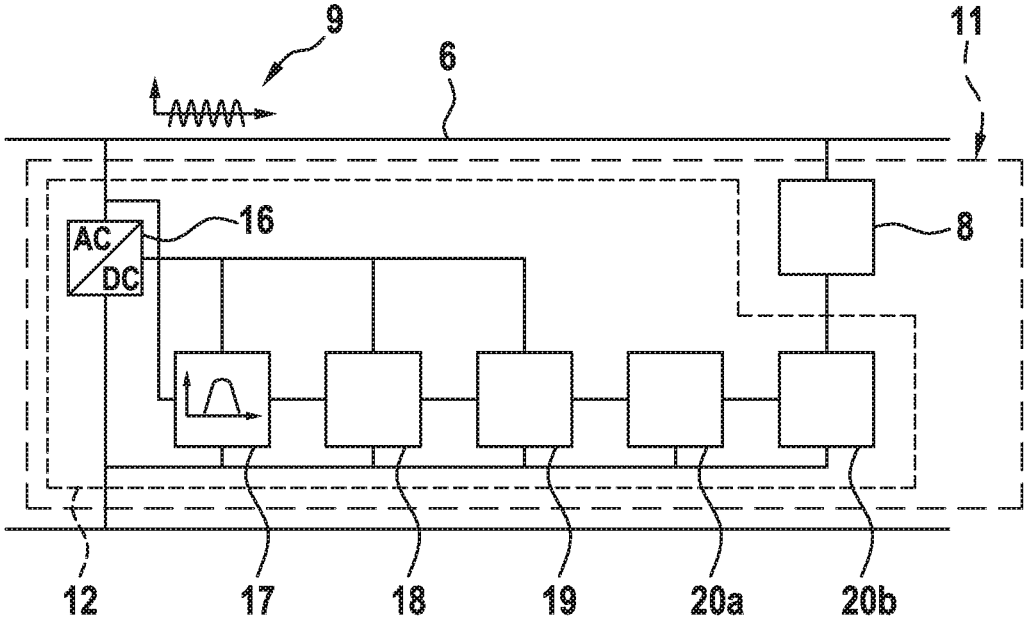
FIG. 4 shows a circuit diagram of an end of branch device.

FIG. 4 shows a circuit diagram of an end of branch device 11. The end of branch device 11 comprises a monitoring device 8 and a switch device 1. The switch device comprises a supply unit 16. The supply unit 16, the switch 12 and the monitoring device 8 are connected with the source device 4 via the transmission medium 6.

The supply unit 16 is provided with the monitoring signal 9. Furthermore, the supply unit 16 is adapted to convert the monitoring signal in usable electric power. The monitoring signal 9 is an AC-signal, whereby the usable electric power is DC. The electric power supplied by the supply unit is provided to the switch 12. The switch 12 also comprises a band pass 17, an one shot unit 18 and a counter unit 19. The band pass 17, the one shot unit 18 and the counter unit 19 are electrically connected with the supply unit 16 to get the electric power. Furthermore, the band pass 17 is connected with a transmission medium 6 such that it is supplied with the monitoring signal 9.

The band pass 17 is adapted that only signals having a frequency in the range of the monitoring signal are passed through to the one-shot unit. Audio signals, which normally have a much smaller frequency, are not passing the band pass 17 and are not provided to the one shot unit 18.

The one shot unit 18 always gives a single pulse if it is provided with a monitoring signal 9. The one shot unit 18 is connected with the counter unit 19 and the counter unit 19 is provided with the pulses given by the one shot unit 18 when it's provided with the monitoring signal 9. The counter unit 19 is counting the pulses given by the one shot unit 18. Especially, the counter unit 19 is counting from zero or one to a maximum number, whereby the counter unit 19 is starting again at zero or one if maximum number is reached and when the power supply is depleted.

The switch 12 comprises a jumper unit 20*a* with a breaker 20*b*. The jumper unit 20*a* can be set by an installer. The jumper unit 20*a* with the breaker 20*b* is adapted to toggle between various stages. One stage connects the monitoring device 8 with the source device 4. The switch 12 is adapted to connect the monitoring device only if the correct number of shots is detected by the switch 12.

Figure 5:
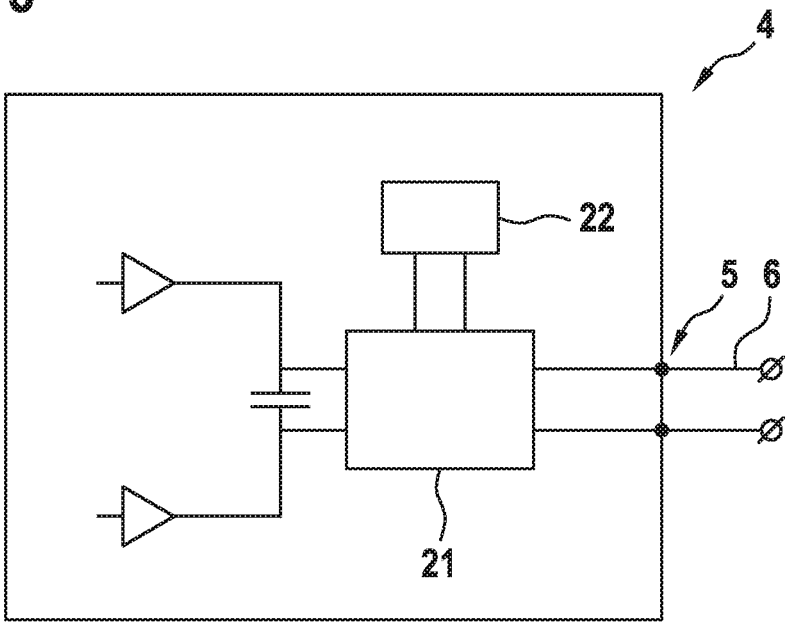
FIG. 5 shows a circuit diagram of a source device.

FIG. 5 shows an example of a source device 4. The source device 4 is formed as an amplifier output stage. The interface 5 is connectable with the transmission medium 6 and connects the outside and/or the loudspeaker line 7 with the electronic inside source device 4. The source device 4 comprises a measurement unit 21. The measurement unit 21 is adapted to detect the harmonic sent by the monitoring device 8 back to the source device 5. The measurement unit 21 comprises a current sensor to detect the harmonic and/or the answer signal 10 and provide them as analog data. The measurement unit 21 is connected with an analog to digital converter 22, whereby the analog to digital converter 22 is adapted to convert the measured current of the measurement unit 21 into digital data, whereby these digital data comprise the information if the answer signal 10 is measured and/or if the loudspeaker line 7 is working correctly.

Figure 6:
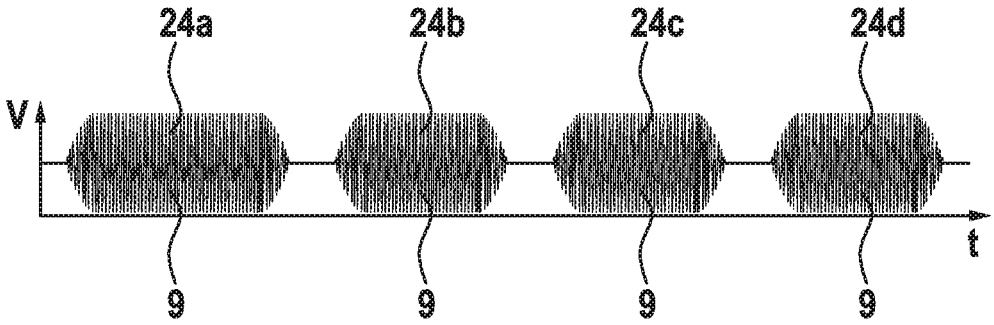
FIG. 6 shows pulses of monitoring signals.

FIG. 6 shows an example how to use the monitoring signal 9 in an end of branch device 11. This diagram is showing the time dependence of the signals and pulses. In this example there are four pulses of the monitoring signal 9 given by the source device 4. A first pulse 24*a* is having a first pulse time, whereby the pulse time of the first pulse may be longer than the pulse time of the following pulses. During the first pulse 24*a* the switch 12 is charged with electricity, whereby the electricity for charging is used out of this pulse 24*a*. After a time without the monitoring signal 9 a second pulse 24*b* is given. These second pulse 24*b* is detected by the one shot unit 18 and a shot is given to the counter unit 19. The counter unit 19 is counting this pulse as one. The jumper unit 20 can adapted to connect the monitoring device 8 with the source device 4 if the counter counts one. After another time without the monitoring signal 9 a third pulse 24*c* is given. The third pulse 24*c* is detected by the one shot unit 18 and another pulse is given to the counter 19. The counter 19 is detecting this pulse as two. The end of branch device is adapted to connect the monitoring device and the source device only as long as the one-shot unit output is high. Especially there is no further pulse needed to disconnect them. However, the jumper unit 20 in a second branch can be set to the counting number 2 which means that for a counter detecting a second pulse, the jumper unit will connect the monitoring device 8 with the source device 4.

After another time a fourth pulse 24*d* is given, whereby this pulse is detected by the one shot unit 18 and provided to the counter unit 19, whereby the counter unit 19 is counting this pulse as number 3. The jumper unit in a third branch can be set to the counting number three, which means that the monitoring device 8 is connected with the source device 4 for the detected fourth. This is a method how to connect the different monitoring devices 8 just by using the same monitoring signal 9 several times.

The invention claimed is:

1. A sound system (1), comprising at least one monitoring device (8), a source device (4) and a transmission medium (6), wherein the monitoring device (8) is connected with the source device (4) via the transmission medium (6), wherein the monitoring device (8) is configured to receive a monitoring signal (9) sent by the source device (4), and wherein the monitoring device (8) is a passive device and configured to send at least one harmonic of the monitoring signal back to the source device (4).

2. The sound system (1) according to claim 1, wherein the harmonic sent by the monitoring device (8) is a second harmonic or greater harmonic of the monitoring signal.

3. The sound system according to claim 1, wherein the monitoring device (8) is configured as an end of line device.

4. The sound system (1) according to claim 1, wherein the monitoring device (8) comprises a resonant circuit with a capacitor (13) and an inductor (14).

5. The sound system (1) according to claim 4, wherein the monitoring device (8) comprises at least one diode (15), wherein the diode (15) is connected parallel to the inductor (14).

6. The sound system (1) according to claim 1, wherein the monitoring device (8) is configured as a filter for suppressing an audio signal.

7. The sound system (1) according to claim 1, wherein the source device (4) comprises a measurement unit to detect the harmonic sent by the monitoring device (8).

8. The sound system (1) according to claim 1, with at least one switch (12) device for connecting and disconnecting the monitoring device (8) and the source device (4).

9. The sound system (1) according to claim 8, wherein the switch device (12) and the monitoring device (8) are forming an end of branch device (11).

10. The sound system (1) according to claim 9, wherein the end of branch device (11) comprises a supply unit (16) for converting energy of the monitoring signal (9) into usable voltage.

11. The sound system (1) according to claim 9, wherein the switch device (12) comprises one shot unit (18), a counter unit (19) and a jumper unit (20), wherein the one shot unit (18) is configured to be triggered by the monitoring signal to send out an pulse, wherein the counter unit (19) is configured to count the pulses sent out by the one shot unit (18), wherein the jumper unit (20) is configured to connect and/or disconnect the monitoring device (8) based on the pulses counted by the counter unit (19).

12. The sound system (1) according to claim according to claim 9, wherein the supply unit (16) is configured to charge the switch device (12) for a first triggering with the monitoring signal (8).

13. The sound system (1) according to claim 9, wherein the switch device (12) comprises a band pass filter (17) tuned for the monitoring signal (9).

14. The sound system according to claim 1, wherein the monitoring device (8) is configured to receive a monitoring signal (9) sent by the source device (4) via the transmission medium (6), and wherein the monitoring device (8) is a passive device and configured to send at least one harmonic of the monitoring signal back to the source device (4) via the transmission medium (6).

15. An end of line device for a sound system (1), comprising a monitoring device (8), wherein the monitoring device (8) is connectable with a source device (4) via a transmission medium (6), wherein the monitoring device (8) is configured to receive a monitoring signal (9) sent by the source device (4), and wherein the monitoring device (8) is a passive device and is configured to send at least one harmonic of the monitoring signal (9) back to the source device (4).

16. The end of branch device (11) for a sound system (1), comprising the end of line device according to claim 15 and a switch device (12), wherein the end of line device is connected with the switch device (12).

17. The end of branch device (11) for a sound system (1) according to claim 15, wherein claim wherein the monitoring device (8) is configured to receive a monitoring signal (9) sent by the source device (4) via the transmission medium (6), and wherein the monitoring device (8) is a passive device and configured to send at least one harmonic of the monitoring signal back to the source device (4) via the transmission medium (6).

* * * * *